US009194161B2

(12) United States Patent
Parsons et al.

(10) Patent No.: US 9,194,161 B2
(45) Date of Patent: Nov. 24, 2015

(54) INTEGRATED PLASTIC RESTRAINT

(71) Applicants: Kevin Parsons, Appleton, WI (US); Siu Ngai Wang, Kowloon (HK)

(72) Inventors: Kevin Parsons, Appleton, WI (US); Siu Ngai Wang, Kowloon (HK)

(73) Assignee: Armament Systems And Procedures, Inc., Appleton, WI (US)

( * ) Notice: Subject to any disclaimer, the term of this patent is extended or adjusted under 35 U.S.C. 154(b) by 81 days.

(21) Appl. No.: 14/058,857

(22) Filed: Oct. 21, 2013

(65) Prior Publication Data

US 2015/0107311 A1 Apr. 23, 2015

(51) Int. Cl.
*E05B 75/00* (2006.01)

(52) U.S. Cl.
CPC ..... *E05B 75/00* (2013.01)

(58) Field of Classification Search
CPC . E05B 75/00; E05B 15/1635; Y10T 24/1498; Y10T 24/141; Y10T 24/44248; Y10T 29/49826; B65D 63/1072; B65D 2563/106; B65D 2563/108; B65D 63/1081; A61F 5/37; B60R 21/213; B60R 21/2171
USPC ..... 70/16; 24/16 PB
See application file for complete search history.

(56) References Cited

U.S. PATENT DOCUMENTS

| | | | | |
|---|---|---|---|---|
| 5,088,158 | A * | 2/1992 | Burkholder | 24/16 PB |
| 5,802,888 | A * | 9/1998 | Parsons | 70/16 |
| 6,101,682 | A * | 8/2000 | Parsons | 24/16 PB |
| 6,196,033 | B1 * | 3/2001 | Dowdle | 70/16 |
| 6,219,887 | B1 * | 4/2001 | Parsons | 24/16 PB |
| 7,789,414 | B2 * | 9/2010 | Blackburn | 280/728.2 |
| 2008/0040896 | A1 * | 2/2008 | Parsons | 24/16 PB |
| 2009/0077773 | A1 * | 3/2009 | Harrington et al. | 24/16 PB |
| 2010/0162775 | A1 * | 7/2010 | Martinez | 70/16 |
| 2010/0229350 | A1 * | 9/2010 | Kostal et al. | 24/16 PB |
| 2010/0269548 | A1 * | 10/2010 | Harrington | 70/16 |

* cited by examiner

*Primary Examiner* — Robert J Sandy
*Assistant Examiner* — David Upchurch
(74) *Attorney, Agent, or Firm* — Hahn Loeser & Parks LLP

(57) ABSTRACT

An apparatus includes an elongated peg and box tube, the peg and box tube are coaxially aligned along a longitudinal axis of the respective peg and are concentric, first and second apertures extending through the peg and box tube, first and second respective arms within the peg each with a plurality of teeth from an exterior wall towards a second, opposing side of the peg directly adjacent one of the first and second apertures and a strap extending from each of the peg and box tube and from opposing longitudinal ends, wherein each of the straps has a plurality of notches extending perpendicular to a longitudinal axis of the strap, where each of the plurality of teeth of the respective arms engages one of the plurality of notches of a respective strap inserted through a corresponding one of the first and second apertures.

20 Claims, 3 Drawing Sheets

INTEGRATED PLASTIC RESTRAINT

FIELD

The field of the invention relates to restraining devices such as handcuffs and more particularly to plastic restraints.

BACKGROUND

Handcuffs are well known. Such devices are typically used by police and military to at least partially restrain people being held in custody.

A pair of handcuffs are constructed of first and second handcuffs connected by a chain. Each handcuff typically includes a bow and frame. The bow is curved to fit around the wrist of a prisoner. One end of the bow is attached to and pivots on the frame. The other end of the bow has a series of sloped teeth that engage a spring-loaded pawl within the frame. A key engages a lock within the frame in order to release the handcuffs from the wrists of a prisoner.

Because of the nature of use, handcuffs must be particularly robust. As such, at least the bow, the frame and most parts of the lock are constructed of metal.

Also because of the nature of use, handcuffs must be difficult to defeat. This is typically accomplished via close tolerances in the construction of the lock and between the bow and frame to resist release of the handcuff via insertion of a metal strip between the spring-loaded pawl and bow. Because of the materials needed for robustness and the tolerances need to defeat tampering, most handcuffs are expensive to produce.

Plastic restraint devices have been proposed as an alternative to handcuffs. However, the plastic locking mechanism of such devices has been found to be subject to damage when used with particularly strong prisoners. Accordingly, a need exists for better methods of producing such devices.

DETAILED DESCRIPTION OF AN ILLUSTRATED EMBODIMENT

Figure 1:
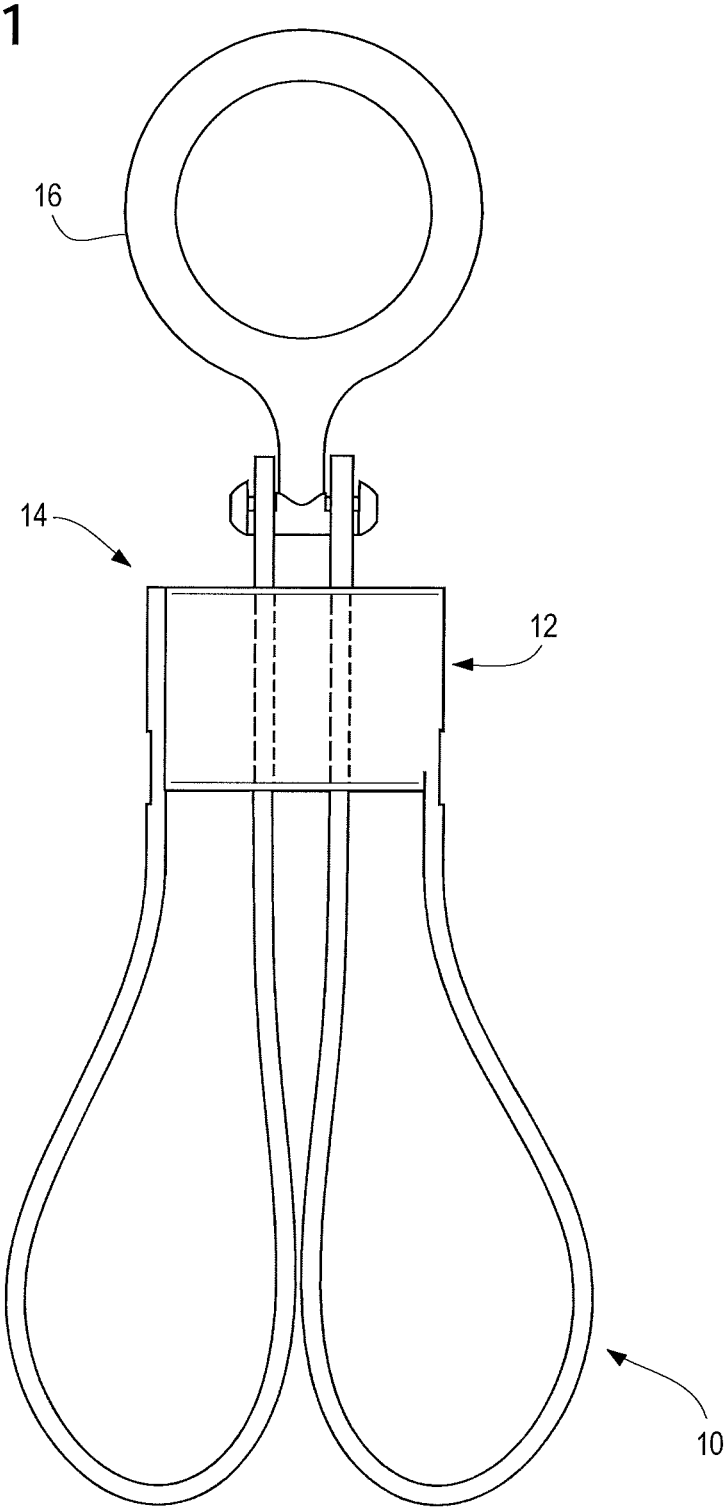
FIG. 1 depicts a plastic retrain shown generally in accordance with an illustrated embodiment.

While embodiments can take many different forms, specific embodiments thereof are shown in the drawings and will be described herein in detail with the understanding that the present disclosure is to be considered as an exemplification of the principles hereof, as well as the best mode of practicing same. No limitation to the specific embodiment illustrated is intended.

FIG. 1 depicts a plastic restraint device 10 shown generally in accordance with an illustrated embodiment. The device of FIG. 1 differs from prior devices in that it is constructed from three integral sub-assemblies that each contribute to the strength of the overall device. Integral in this context means that the sub-assemblies are each constructed from a single piece of plastic with no discontinuities in the plastic of the sub-assembly caused by subsequent joining methods (e.g., gluing, riveting, ultrasonic welding, screws, bolts, etc.).

Figure 2:
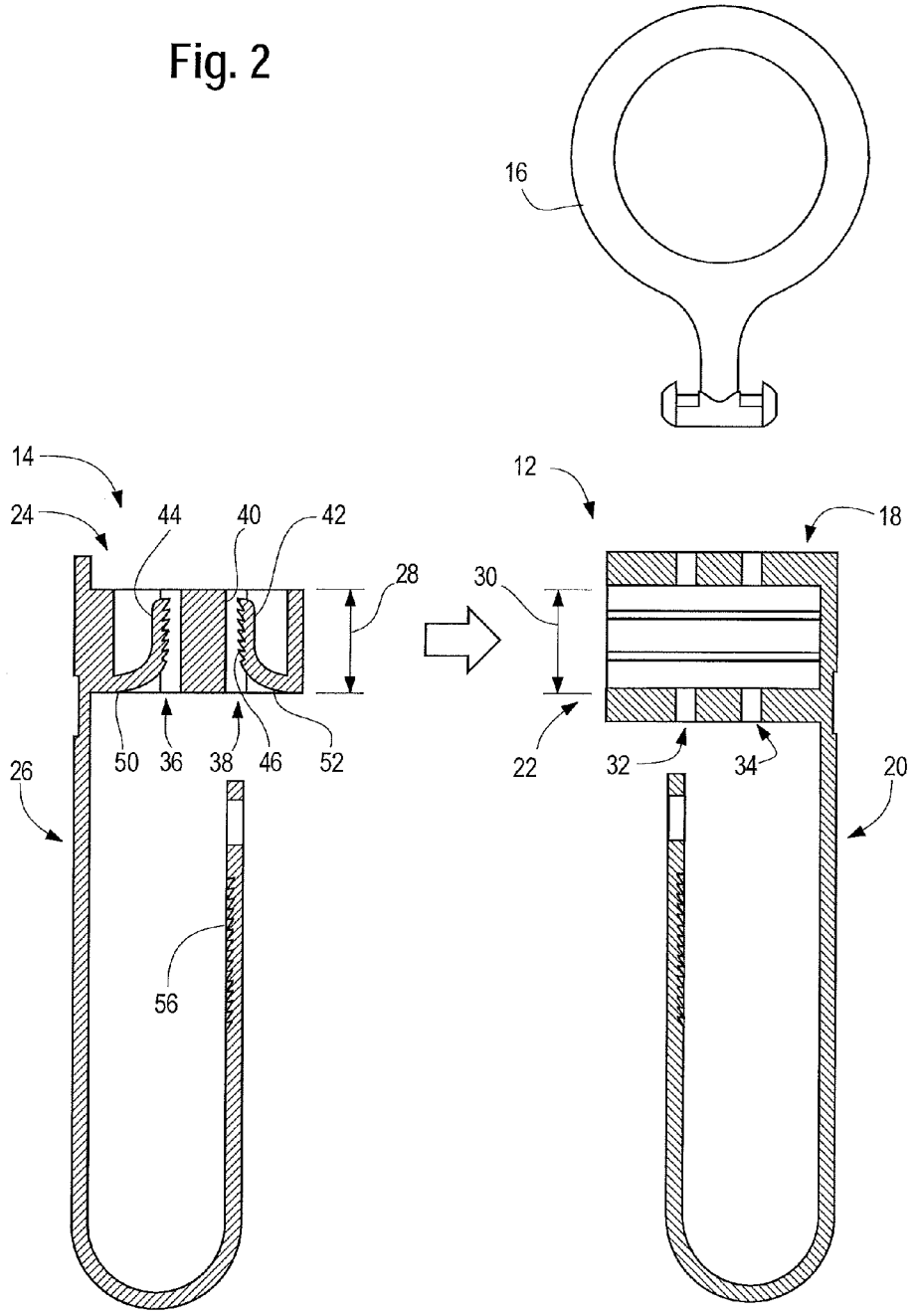
FIG. 2 is an exploded cut-away view of the restraint of FIG. 1.

In this regard, the plastic restraining device includes a first strap assembly 12, a second strap assembly 14 and a handle 16. FIG. 2 shows a cut-away, exploded view of the device of FIG. 1.

As shown in FIGS. 1 and 2, the first strap assembly includes a first, box structure 18 and a strap 20 integrally coupled to the box structure. The box structure may be instantiated as a rectangular or square tube with a first, open end 22 and a second, opposing end that is coupled to the strap 20. The second end of the tube may be closed and may be part of the strap where the strap extends away from the tube perpendicular to a longitudinal axis of the tube.

The first box structure also includes a first aperture 32 and a second aperture 34. The first and second apertures extend through opposing side walls (or opposing sides of the rectangular annulus) that defines the tube. The first and second apertures each extend through the first box structure in a direction perpendicular to the longitudinal axis of the first box structure.

Similarly, the second strap assembly includes a second box structure 24 integrally coupled to a second strap 26. The second box structure may be a modified box tube or peg that fits inside of the first box tube 18.

The second box structure may also include a first aperture 36 and a second aperture 38. The first and second apertures extend through opposing side walls (or opposing sides of the rectangular annulus) that defines the second box structure. The first and second apertures of the second box structure each extend through the second box structure in a direction perpendicular to a longitudinal axis of the first box structure 18. A center divider 40 extending perpendicular to the longitudinal axis of the second box structure separates the first and second apertures.

Included within the second box structure is a pair of aims 42, 44 that are positioned directly adjacent a respective aperture 36, 38. Each of the arms extend from a lower sidewall 50, 52 towards up upper surface of the second box structure parallel to the direction of the respective aperture. A number of sloped teeth 46 (e.g., six) extend from the respective arms 42, 44 into the respective adjacent aperture 36, 38.

Figure 3:
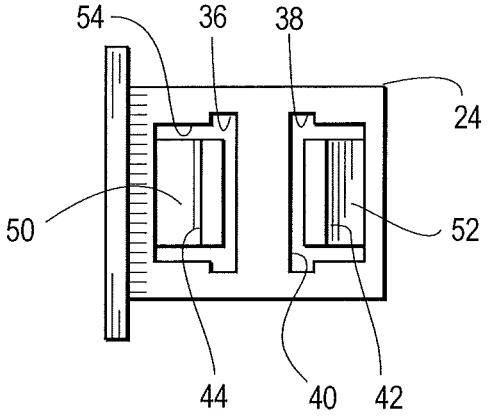
FIG. 3 is a top view of a portion of the restraint of FIG. 1.

FIG. 3 is a top view of the second box structure. As shown in FIG. 3, a slot 54 is provided on opposing longitudinal sides of the respective sidewalls 50, 52 that connect the arms 42, 44 to the opposing ends of the second box structure. The slots provide additional flexibility in allowing the arms 42, 44 to resiliently flex away from the divider 40 when the straps 20, 26 are inserted through the apertures between the arm and divider.

In this regard, an outside diameter 28 of the second box-like structure is slightly smaller (e.g., by a few tenths of a millimeter) than the inside diameter 30 of the first box-like structure. The smaller diameter allows the second box-like structure to slide inside of the first box-like structure In order to assemble the first strap assembly to the second strap assembly, the longitudinal axis of the first and second box-like structures are aligned (i.e., the first and second box structures are coaxial) and the second box structure is urged inside the first box structure. Once full inserted, the first and second box structures are substantially concentric.

Once fully inserted, the first aperture 32 of the first strap assembly is aligned with the first aperture 36 of the second box structure. Similarly, the second aperture 34 of the first strap assembly is aligned with the second aperture 38 of the second box structure.

Next, the strap 20 is inserted through the aligned apertures 34, 38. Similarly, the strap 26 is inserted through aligned apertures 32, 36. A pair of opposing pegs on the lower end of the handle engage an aperture on a distal end each of the straps.

In this regard, the straps are each provided with a series of transverse, sloped teeth 56 that extend across the width of each of the straps (i.e., the teeth 56 extend across the straps in a direction transverse to the longitudinal axis of the straps). It should be noted in this regard that the slope of the sloped teeth of the straps is opposite in direction to the slope of the teeth of the arms. As a result, as the straps are inserted through the respective apertures, the sloped teeth of the straps easily ride up and over the sloped teeth of the arms.

Once inserted through the apertures, the straps cannot be removed. This is the case because the non-sloped sides of the respective teeth on the arms and straps positively engage one another and cannot be released or otherwise disengaged. The net result is that the strap can only be pushed further into the box structures but the direction of movement cannot be reversed.

In general, the plastic restraints of FIGS. 1-3 are dramatically stronger than prior devices. This is due to the concentric box-within-a-box design. For example, many prior plastic restraint devices used two strap assemblies that each had a small box including a single aperture and arm on each end of the two straps that were then joined at a midpoint of a separate connecting box tube. The problem with this design is that the common box tube would fracture at the center where the two small boxes met.

The device of FIGS. 1-3 avoids this problem through the use of concentric, coextensive box tubes. Moreover, the concentric design allows the stress from each locking arm to be shared between the inner and outer layers provided by the concentric design thereby allowing stress concentrations to be distributed outwards through the two layers. This is not possible in prior devices.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

an elongated peg and box tube, the peg and box tube are coaxially aligned along a longitudinal axis of the respective peg and box tube, the peg is inserted inside the annulus of the box tube and is concentric with the box tube;

first and second apertures each extending through the concentric peg and box tube perpendicular to the longitudinal axis at respective predetermined distances from opposing longitudinal ends of the concentric peg and box tube;

first and second respective arms within the peg each with a plurality of teeth, the arms extend perpendicular to the longitudinal axis from an exterior wall towards a second, opposing side of the peg directly adjacent one of the first and second apertures with the plurality of teeth extending into the one aperture; and a respective strap extending from each of the peg and box tube and from opposing longitudinal ends of the coaxially aligned peg and box tube, wherein each of the straps has a plurality of notches extending perpendicular to a longitudinal axis of the strap, where each of the plurality of teeth of the respective arms engages one of the plurality of notches on a distal end of a respective strap inserted through a corresponding one of the first and second apertures.

2. The apparatus as in claim 1 further comprising the straps extending from the ends of the peg and box tube perpendicular to the longitudinal axis.

3. The apparatus as in claim 1 wherein the apertures further comprise slots extending perpendicular to the longitudinal axis.

4. The apparatus as in claim 3 further comprising a divider connecting opposing interior walls of the peg between the first and second apertures.

5. The apparatus as in claim 4 further comprising the teeth of the arms facing the divider across the aperture.

6. The apparatus as in claim 1 further comprising the arms extending from opposing ends of the peg through a right angle bend.

7. The apparatus as in claim 6 wherein the exterior walls of the peg are slotted between a base of the arms and the opposing ends to allow the exterior walls between the end of the peg and base of the arm to flex.

8. The apparatus as in claim 1 wherein each of the peg and box tube and their respective arms and straps further comprise an integral assembly formed from a single piece of material without any discontinuities of any kind formed by joining different portions.

9. An apparatus comprising:

first and second strap assemblies, the first strap assembly further comprises an elongated tube and a strap, the elongated tube is open on a first longitudinal end and has a strap extending from the second longitudinal end wherein an annulus that defines the elongated tube has a rectangular shape extending along the longitudinal axis, the elongated tube has first and second apertures extending through the tube perpendicular to the longitudinal axis and the second strap assembly further comprises an elongated rectangular peg with a strap extending from a first end, the elongated peg has first and second apertures extending through the peg perpendicular to the longitudinal axis of the peg, the outside dimensions of the rectangular peg of the second strap assembly is slightly smaller than the inside rectangular dimensions of the rectangular tube of the first strap assembly so that the longitudinal tube and peg of the first and second strap assemblies can be combined by sliding the second end of the elongated rectangular peg of the second strap assembly into the open end of the longitudinal tube of the first strap assembly wherein upon insertion of the rectangular peg into the rectangular tube, the first and second apertures of the first strap assembly align with the respective first and second apertures of the second strap assembly and the peg and tube are concentric wherein the rectangular peg of the second strap assembly has a respective arm with a plurality of teeth directly adjacent each of the apertures extending from an exterior wall on a first side towards a second side along the aperture wherein each of the straps has a plurality of notches extending perpendicular to a longitudinal axis of the strap, each of the plurality of teeth of the respective arms engages one of the plurality of notches upon insertion of the straps into the respective apertures of the combined elongated tube and peg.

10. The apparatus as in claim 9 further comprising a respective slot extending from the aperture along each opposing side of the respective arms towards a respective end of the peg, the slots allow the arm and exterior wall between the slot to flex as the respective strap is inserted into the aperture.

11. The apparatus as in claim 9 further comprising a divider disposed within the peg between the apertures, the teeth of the arms on opposing sides of the divider face the divider across the aperture.

12. The apparatus as in claim 9 further comprising a handle that engages a distal end of the respective straps.

13. An apparatus comprising:

first and second concentric box tubes, the box tubes are coaxially aligned along a longitudinal axis of the respective box tubes and are concentric, the annulus of the second box tube is inserted inside the annulus of the first box tube;

first and second apertures each extending through opposing sides of the concentric box tubes perpendicular to the longitudinal axis at respective predetermined distances from opposing longitudinal ends of the concentric tubes;

first and second respective arms within the second box tube with a plurality of teeth, the arms extend perpendicular to the longitudinal axis from a first side towards a second side of the second box tube directly adjacent each of the respective apertures with the plurality of teeth extending into and along the aperture; and a strap extending from each respective box tube and from opposing longitudinal ends of the coaxially aligned box tubes, wherein each of the straps has a plurality of notches extending perpendicular to a longitudinal axis of the strap, where each of the plurality of teeth of the respective arms engages one of the plurality of notches of a respective strap inserted through a corresponding one of the first and second apertures.

14. The apparatus as in claim 13 wherein the plurality of teeth on each arm further comprises six.

15. The apparatus as in claim 13 further comprising the straps extending from the ends of the box tubes perpendicular to the longitudinal axis.

16. The apparatus as in claim 13 wherein the apertures further comprise slots extending perpendicular to the longitudinal axis.

17. The apparatus as in claim 16 further comprising a divider connecting opposing inside walls of the second box tube between the first and second apertures.

18. The apparatus as in claim 17 further comprising the teeth of the arms face the divider across the aperture.

19. The apparatus as in claim 13 further comprising the arms extending from opposing ends of the second box tube through a right angle bend wherein the annulus of the second box tube is slotted between a base of the arm and the opposing ends to allow the annulus between the end of the tube and arm to flex.

20. The apparatus as in claim 13 wherein each of the first and second box tubes and their respective arms and straps further comprise an integral assembly formed from a single piece of material without any discontinuities of any kind formed by joining different portions.

* * * * *

UNITED STATES PATENT AND TRADEMARK OFFICE

CERTIFICATE OF CORRECTION

PATENT NO. : 9,194,161 B2
APPLICATION NO. : 14/058857
DATED : November 24, 2015
INVENTOR(S) : Parsons et al.

It is certified that error appears in the above-identified patent and that said Letters Patent is hereby corrected as shown below:

IN THE SPECIFICATION

In column 2, line 30, delete “aims” and substitute therefor --arms--

Signed and Sealed this
Twenty-ninth Day of March, 2016

Michelle K. Lee

Michelle K. Lee
*Director of the United States Patent and Trademark Office*